US009290013B2

(12) United States Patent
Izawa et al.

(10) Patent No.: US 9,290,013 B2
(45) Date of Patent: Mar. 22, 2016

(54) INKJET RECORDING APPARATUS

(71) Applicant: MIYAKOSHI PRINTING MACHINERY CO., LTD., Narashino-shi, Chiba (JP)

(72) Inventors: Hideo Izawa, Narashino (JP); Takao Namiki, Narashino (JP); Yasushi Katagiri, Narashino (JP); Akira Ishikawa, Narashino (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 14/572,202

(22) Filed: Dec. 16, 2014

(65) Prior Publication Data

US 2015/0375531 A1 Dec. 31, 2015

(30) Foreign Application Priority Data

Jun. 25, 2014 (JP) ..... 2014-130816

(51) Int. Cl.
*B41J 2/01* (2006.01)
*B41J 3/00* (2006.01)
*B41J 11/00* (2006.01)

(52) U.S. Cl.
CPC ..... *B41J 11/0015* (2013.01)

(58) Field of Classification Search
CPC .... B41J 2202/20; B41J 3/4078; B41J 11/002; B41J 11/0015
USPC ..... 347/4, 49, 101, 102, 104, 105
See application file for complete search history.

(56) References Cited

U.S. PATENT DOCUMENTS

2010/0194814 A1 8/2010 Izawa et al.
2014/0063167 A1 3/2014 Kanemoto

FOREIGN PATENT DOCUMENTS

EP 2 923 844 A1 9/2015
JP 08108588 A * 4/1996
JP 2004-277995 A 10/2004

OTHER PUBLICATIONS

European Patent Office Search Report for corresponding European Application No. 15150256.4 (7 pgs.).

* cited by examiner

*Primary Examiner* — Jannelle M Lebron
(74) *Attorney, Agent, or Firm* — Flynn, Thiel, Boutell & Tanis, P.C.

(57) ABSTRACT

An inkjet recording apparatus 100 is provided with a fabric feeding section A having a medium for recording 1 composed of a fabric, an inkjet section B for performing inkjet recording on the medium for recording 1 fed from the fabric feeding section A to form a recorded medium 1*a*, and a treating section C1, C2 having a drying section 11, 21 for drying the recorded medium 1*a* and a collecting section 12, 22 for collecting the dried recorded medium, the drying section 11, 21 and the collecting section 12, 22 being integrated with each other, where the treating section C1, C2 is attachable to and detachable from the inkjet section B.

10 Claims, 8 Drawing Sheets

INKJET RECORDING APPARATUS

TECHNICAL FIELD

The present invention relates to an inkjet recording apparatus, and in particular to an inkjet recording apparatus which makes an aspect of collection selectable to prevent quality deterioration at a collecting time and can be properly accommodated to an apparatus utilized at a post process.

BACKGROUND ART

A recent inkjet recording apparatus is provided with a drying section and a collecting section in addition to a recording section, where these sections are configured integrally. Therefore, even in a small space, recording on a medium for recording is continuously performed (hereinafter, the recording performed by the inkjet recording apparatus is also called "inkjet recording"), so that a recorded medium obtained by drying the material can be obtained in a short time.

Now, since the inkjet recordings can record a desired design or character easily, they are used in a wide range of fields. Among them, an inkjet recording using a fabric as a medium for recording is paid attention to.

For example, such an inkjet recording apparatus is known that a feeding-in roll for feeding in a fabric continuously and a dancer roll apparatus are provided on an upstream side of an inkjet recording section sequentially from an upstream side in a travelling direction of the fabric, while a pulling roll for continuously pulling and peeling off the fabric from a downstream end portion of a transporting conveyer intermittently transporting the fabric and a drying section in the inkjet recording section are provided on the downstream side of the inkjet recording section (for example, see PT1).

CITATION LIST

Patent Literature

PTL 1: Japanese Patent Application Laid-Open No. 2010-180488

SUMMARY OF INVENTION

Technical Problem

However, the inkjet recording apparatus described in the above-described PTL 1 can accommodate inkjet recording using a specific fabric, but it cannot be said that the apparatus can accommodate various types of fabrics necessarily.

For example, in the inkjet recording apparatus described in the above-described PTL 1, since the fabric is collected in a folding machine, there is a drawback that when a fabric that creases easily is folded and collected in the folding machine, a fold occurs in the material of the fabric.

On the other hand, when an inkjet recording apparatus provided with a taking-up machine is used, there is such a drawback that when a stretchable fabric such as a spandex is taken up and collected, the material of the fabric is stretched so as to exceed a scheduled length and is taken up.

That is, when various types of fabrics are collected in the same inkjet recording apparatus, there is a possibility that qualities thereof are deteriorated.

Incidentally, it is considerably inefficient to prepare inkjet recording apparatuses corresponding to the characteristics of respective fabrics.

Further, even if an aspect of the collection can be determined arbitrarily, at a post process such as a steaming (coloring) process or a washing process, it is necessary to select the aspect of the collection corresponding to an apparatus used in the post process.

The present invention has been made in view of the above circumstances, and an object thereof is to provide an inkjet recording apparatus that makes an aspect of collection selective to prevent quality deterioration at a collecting time and to be capable of being properly accommodated to an apparatus used at a post process.

Solution to Problems

The present inventors have made an intensive investigation for solving the above problem, and have found that the above problem can be solved by making a treating section composed of a drying section and a collecting section integrated with each other attachable and detachable and have made the present invention.

The present invention lies in (1) an inkjet recording apparatus provided with a fabric feeding section having a medium for recording composed of a fabric, an inkjet section for performing inkjet recording to the medium for recording fed from the fabric feeding section to form a recorded medium, and a treating section composed of a drying section for drying the recorded medium and a collecting section for collecting the recorded medium, the drying section and the collecting section being integrated with each other, wherein the treating section is attachable to and detachable from the inkjet section.

The present invention lies in (2) the inkjet recording apparatus according to the above (1), wherein the collecting section is a taking-up type collecting section for taking up the recorded medium to collect the same or a folding type collecting section for folding the recorded medium to collect the same, and by attaching/detaching the treating section to/from the inkjet section, the treating section provided with the taking-up type collecting section and the treating section provided with the folding type collecting section can be exchanged with each other.

The present invention lies in (3) the inkjet recording apparatus according to the above (1) or (2), wherein a rear portion of the inkjet section is provided with a portion to be coupled, a front portion of the treating section is provided with a coupling portion, and by coupling the coupling portion and the portion to be coupled, the treating section and the inkjet section are coupled to each other.

The present invention lies in (4) the inkjet recording apparatus according to the above (3), wherein the portion to be coupled is composed of a projecting coupling pin, and the coupling portion is composed of a shaft portion and a coupling lever having a hook portion and rotatable about the shaft portion.

The present invention lies in (5) the inkjet recording apparatus according to any one of the above (1) to (4), wherein a rear portion of the inkjet section is provided with a portion to be positioned, a front portion of the treating section is provided with a positioning portion, and by causing the positioning potion to abut on the portion to be positioned, the treating section is positioned to the inkjet section.

The present invention lies in (6) the inkjet recording apparatus according to the above (5), wherein the portion to be positioned is composed of a box-shaped block guide having an inclination portion, the positioning portion is composed of an L-shaped plate guide in a plan view, and by causing at least two faces of the plate guide to abut on the block guide, the treating section is positioned to the inkjet section.

The present invention lies in (7) the inkjet recording apparatus according to any one of the above (1) to (6), wherein a plurality of the inkjet sections are arranged in series.

The present invention lies in (8) the inkjet recording apparatus according to the above (7), further including another fabric feeding section between the inkjet sections adjacent to each other.

The present invention lies in (9) the inkjet recording apparatus according to any one of the above (1) to (8), wherein the inkjet recording is performed by a serial-type recording head.

The present invention lies in (10) the inkjet recording apparatus according to any one of the above (1) to (9), wherein casters are attached to a lower end portion of the treating section.

Advantageous Effects of Invention

In the inkjet recording apparatus of the present invention, since the treating section composed of the drying section for drying a recorded medium and the collecting section for collecting the dried recorded medium, the drying section and the collecting section being integrated with each other, is attachable to and detachable from the inkjet section, a recorded medium with a high quality can be obtained efficiently by making an exchange between the treating sections properly in response to the characteristic of a medium for recording composed of a fabric.

For example, when a fabric which creases easily is used as the medium for recording, the taking-up type collecting section for taking up a recorded medium to collect the same can be adopted. Thereby, a fold can also be prevented from being formed at a collecting time. Further, a drying section suitable for the taking-up type collecting section can be adopted.

On the other hand, when a fabric such as stretchable spandex (polyurethane elastic fiber) is used, the folding type collecting section for folding a recorded medium to collect the same can be adopted. Thereby, the texture (fabric) of the fabric is prevented from being stretched so as to exceed a scheduled length at a collecting time. Further, a drying section suitable for the folding type collecting section can be adopted.

In addition, by making the aspect of collection selectable, accommodation to an apparatus to be used at a post process can be achieved.

In the inkjet recording apparatus of the present invention, the rear portion of the inkjet section is provided with the portion to be coupled, the front portion of the treating section is provided with the coupling section, and the treating section and the inkjet section can be coupled to each other simply and securely by coupling the portion to be coupled and the coupling section.

In addition, simultaneously, it is possible to position the treating section to the inkjet section.

For example, when the portion to be coupled is composed of a projecting coupling pin, the coupling potion is composed of a shaft portion and a coupling lever having a hook portion and rotatable about the shaft portion, the hook portion is hooked to the coupling pin by rotating the coupling lever.

In the inkjet recording apparatus of the present invention, the rear portion of the inkjet section is provided with the portion to be positioned, the front portion of the treating section is provided with the positioning portion, and the positioning of the treating section to the inkjet section can be performed simply and more accurately by causing the positioning portion to abut on the portion to be positioned.

For example, when the portion to be positioned is composed of a box-type block guide having an inclination portion and the positioning portion is an L-shaped plate guide in a plan view, the positioning can be achieved by causing at least two faces of the plate guide to abut on the block guide.

In the inkjet recording apparatus of the present invention, since the treating section is attachable and detachable, a plurality of independent, inkjet sections can be arranged in series.

The treating section can be attached to the inkjet section at the most downstream side.

Incidentally, when the inkjet section and the drying section are integrated with each other, only the inkjet sections cannot be arranged in series.

In this case, the number of kinds of ink to be used can be increased.

Further, different types of ink are charged to the respective inkjet sections and the inkjet section used to perform inkjet recording can be selected in response to the characteristic of the fabric.

For example, when dispersible ink is charged into the inkjet section on the upstream side and reactive ink is charged into the inkjet section on the downstream side, such a configuration can be adopted that when a fabric made of polyester is used, inkjet recording is performed by the inkjet section on the upstream side, and when a fabric made of cotton is used, inkjet recording is performed by the inkjet section on the downstream side.

It should be noted that when the inkjet sections are arranged in a widthwise direction, the two inkjet sections are spaced from each other in the widthwise direction, so that a large space is required and the treating sections must be provided to the respective inkjet sections, and two operators are also required.

At this time, when another fabric feeding section is further provided between the inkjet section on the upstream side and the inkjet section on the downstream side, it is also possible to use only the inkjet section on the downstream side to perform inkjet recording.

In the inkjet recording apparatus of the present invention, since inkjet recording is performed by a serial-type recording head, a travelling distance of the recording head can be changed in response to the width of the fabric. Thereby, a time required for inkjet recording can be shortened.

In the inkjet recording apparatus of the present invention, since casters are attached to a lower end portion of the treating section, exchange between the treating sections can be performed easily by utilizing the casters.

DESCRIPTION OF EMBODIMENTS

Preferred embodiments of the present invention will be described below in detail with reference to the drawings according to necessity. It should be noted that same elements are attached with the same reference signs and repetitive explanation thereof is omitted. Further, a positional relationship such as upper and lower or left and right is based upon a positional relationship shown in the respective figures unless otherwise noted. Further, a size ratio between the figures is not limited to the illustrated ratio.

First Embodiment

Figure 1:
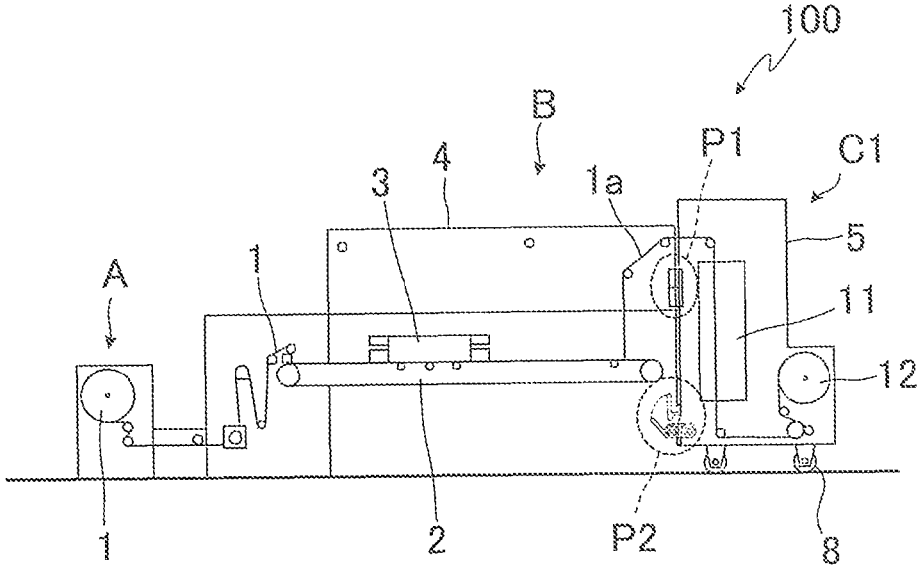
FIG. 1 is a schematic side view showing an inkjet recording apparatus according to a first embodiment.

FIG. 1 is a schematic side view showing an inkjet recording apparatus according to a first embodiment.

As shown in FIG. 1, an inkjet recording apparatus 100 according to the first embodiment is provided with a fabric feeding section A having a medium for recording 1 composed of a fabric, an inkjet section B for performing inkjet recording to the medium for recording 1 to form a recorded medium 1*a*, and a treating section C1 composed a drying section 11 for drying the recorded medium 1*a* and a taking-up type collecting section 12 for taking up the dried recorded medium 1*a* to collect the same, the drying section 11 and the taking-up type collecting section 12 being integrated with each other.

Further, in the inkjet recording apparatus 100, the treating section C1 is attachable to and detachable from the inkjet section B. It should be noted that such attaching and detaching operations will be described later.

The fabric feeding section A has the medium for recording 1 which has been taken up on a roll.

Here, as the medium for recording 1, any fabric can be adopted without being limited particularly. For example, as the aspect of the fabric, a woven fabric, a knit, a braid, a lace, a nonwoven fabric, and the like are involved, and as the material of the fabric, cotton, hemp, silk, wool, polyester, polyamide, acrylic, vinylon, polyolefin, polyurethane, rayon, acetate, and the like are involved. These materials may be used alone or in combination of a plurality thereof.

Further, an ink absorbing layer for absorbing ink may be provided on the fabric. It should be noted that as the ink absorbing layer, a known one may be adopted.

It should be noted that in the treating section C1, since the recorded medium 1*a* is taken up and collected by the taking-up type collecting section 12, fabrics poor in stretchability (for example, a woven fabric and the like) are suitably used as the medium for recording 1. Further, the drying section 11 suitable for these fabrics may be adopted.

In the fabric feeding section A, when the medium for recording 1 is pulled out, the medium for recording 1 which has been taken up on a roll is freely rotated and the medium for recording 1 is continuously fed. It should be noted that the aspect of feeding the medium for recording 1 is not limited to this aspect, but a known aspect can be adopted.

The inkjet section B has a transporting conveyer 2 for transporting the medium for recording 1, a recording head 3 for performing inkjet recording to the medium for recording 1, and a first frame 4 for housing the transporting conveyer 2 and the recording head 3.

Further, a rear portion (a downstream side) of the first frame 4 of the inkjet section B is provided with a pair of left and right portions to be positioned and coupling portions.

Here, the recording head 3 is constituted as one of a serial type. That is, the recording head 3 is configured so as to perform inkjet recording to the medium for recording 1 while reciprocating in a direction perpendicular to a traveling direction of the medium for recording 1. Therefore, in the inkjet recording apparatus 100, since a travelling distance (a travelling distance in a widthwise direction of a medium for recording) of the recording head 3 can be changed in response to the width of the medium for recording 1, it is made possible to shorten a recording time.

The ink used in the inkjet section B is not limited particularly, but dispersible ink, acidic ink, direct ink, cationic ink, reactive ink, pigment ink, and the like can be used.

The portion to be positioned is caused to abut on the positioning portion provided at a front portion (an upstream side) of the treating section C1 described later, so that the treating section C1 is easily positioned to the inkjet section B.

Further the portion to be coupled is coupled to a coupling portion provided at a front portion of the treating section C1 described later, so that the treating section C1 and the inkjet section B are easily and securely coupled to each other.

It should be noted that details of the coupling and the positioning of the inkjet section B and the treating section C1 will be described later.

In the inkjet section B, when the medium for recording 1 fed from the fabric feeding section A is transported by the transporting conveyer 2 to reach the recording head 3, inkjet recording is performed by the recording head 3. It should be noted that the inkjet recording is performed based upon record information from a computer (not shown) storing image data and the like therein in the same manner as a known method.

The medium for recording 1 forms the recorded medium 1*a* which has been subjected to inkjet recording.

Figure 2:
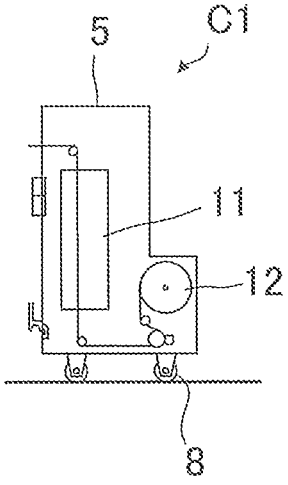
FIG. 2 is a schematic side view showing a treating section of the inkjet recording apparatus according to the first embodiment.

FIG. 2 is a schematic side view showing the treating section of the inkjet recording apparatus according to the first embodiment.

As shown in FIG. 2, the treating section C1 has such a structure that the drying section 11 having a heating and drying apparatus (not shown) and the taking-up type collecting section 12 having a taking-up roll for taking up the dried recorded medium 1*a* are housed in a second frame 5 to be integrated with each other.

Further, a pair of left and right positioning portions and a pair of left and right coupling portions are provided at a front portion of the second frame 5 of the treating section C1.

In addition, casters 8 are attached to a lower end portion of the treating section C1. Therefore, attaching and detaching of the treating section C1 can be performed easily by utilizing the casters 8.

In the treating section C1 when the recorded medium 1*a* transported from the inkjet section B reaches the drying section 11, the recorded medium 1*a* is heated and dried by the heating and drying apparatus while being transported as it is.

Here, the drying section 11 is configured to be long in a vertical direction. That is, the recorded medium 1*a* enters the drying section 11 from an upper portion thereof and after dried, it goes out from a lower portion of the drying section 11.

Since the drying section 11 is vertically long in this manner, the treating section C1 can be made more compact.

The heated and dried recorded medium 1*a* is taken up on a roll of the taking-up type collecting section 12 so that the recorded medium 1*a* which has been subjected to inkjet recording is collected.

It should be noted that the collected recorded medium 1*a* is fed to a post process such as steaming (coloring) or water washing according to necessity.

Figure 3A:
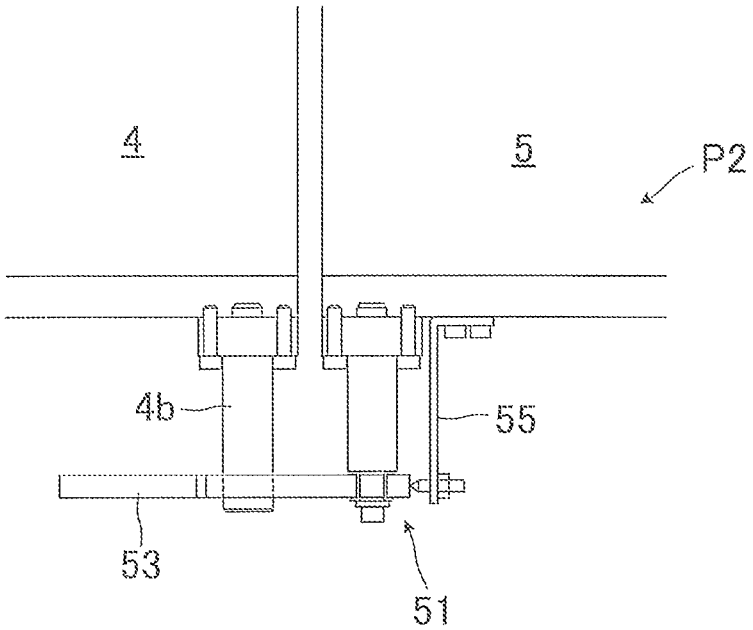
FIG. 3A shows a portion P2 in FIG. 1 and is an enlarged plan view of a portion to be coupled and a coupling portion of the inkjet recording apparatus according to the first embodiment.

FIG. 3A shows a portion P2 in FIG. 1 and is an enlarged plan view of a portion to be coupled and a coupling portion of the inkjet recording apparatus according to the first embodiment. Further, FIG. 3B is a side view of the portion to be coupled and the coupling portion.

It should be noted that one of a pair of portions to be coupled and coupling portions will be described here. The other has a similar structure to the one.

Figure 3B:
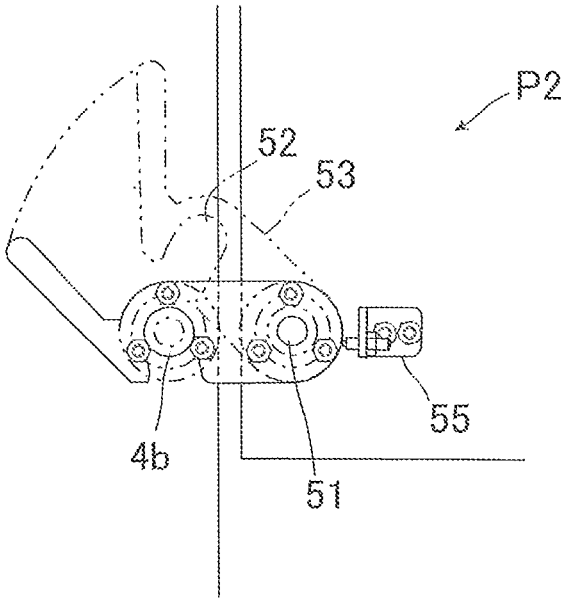
FIG. 3B is a side view of the portion to be coupled and the coupling portion.

As shown in FIG. 3A and FIG. 3B, the portion to be coupled of the inkjet section B is provided at a rear side face of the first frame 4, and is composed of a coupling pin 4*b* projecting from the side face outward.

On the other hand, the coupling portion of the treating section C1 is provided at a front side face of the second frame 5, and is composed of a shaft portion 51 and a coupling lever 53 having a hook portion 52 and rotatable about the shaft portion 51.

In the inkjet recording apparatus 100, the inkjet section B and the treating section C1 are coupled to each other by rotating the coupling lever 53 in a state where the first frame 4 of the inkjet section B and the second frame 5 of the treating section C1 have been made sufficiently close to each other and hooking the coupling pin 4*b* to the hook portion 52.

At this time, it is also possible to position the treating section C1 to the inkjet section B by fitting the coupling pin 4*b* to the hook portion 52 such that a clearance therebetween does not occur.

It should be noted that when the inkjet section B and the treating section C1 are not in a coupled state, the coupling lever 53 is rotated rightward in FIG. 3B.

In this connection, a retaining pin 55 for pressing the coupling lever 53 by a spring force is provided at the second frame 5, and a hole (not shown) is provided in the coupling lever 53. When the coupling lever 53 is rotated, the coupling lever 53 is held in its open state by fitting a distal end of the retaining pin 55 into the hole.

Figure 4A:
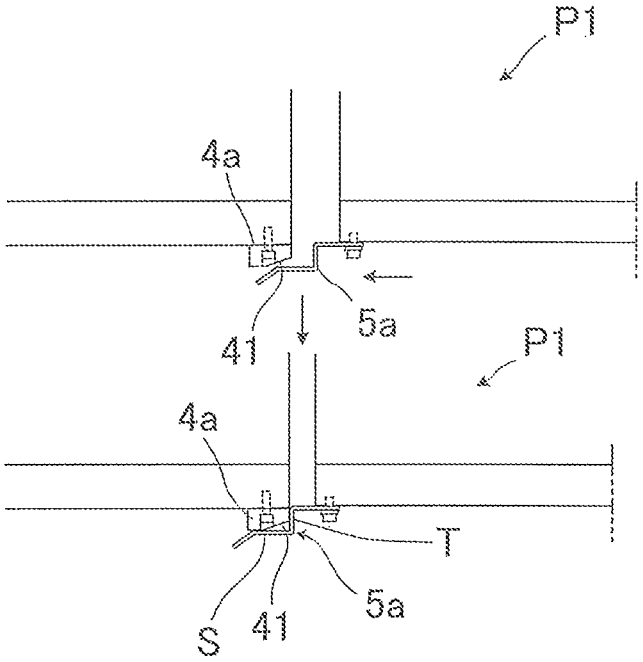
FIG. 4A shows a portion P1 in FIG. 1 and is an enlarged top view of a portion to be positioned and a positioning portion of the inkjet recording apparatus according to the first embodiment.

FIG. 4A shows a portion P1 in FIG. 1 and is an enlarged plan view of a portion to be positioned and a positioning portion of the inkjet recording apparatus according to the first embodiment. Further, FIG. 4B is a side view of the portion to be positioned and the positioning portion.

It should be noted that one of a pair of portions to be positioned and positioning portions will be described here, but the other has a similar structure to the one.

Figure 4B:
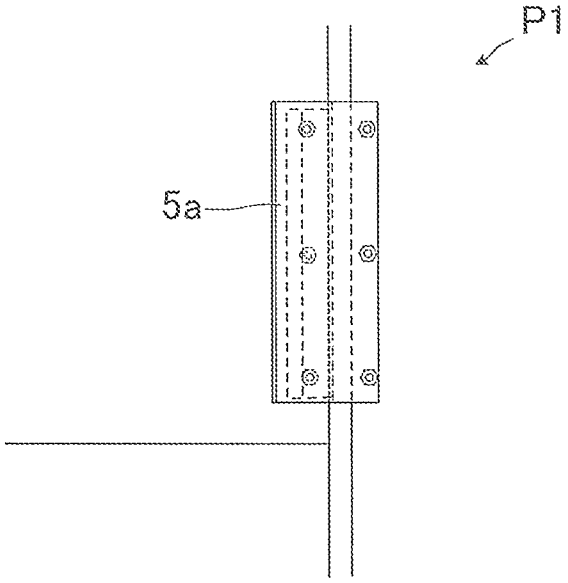
FIG. 4B is a side view of the portion to be positioned and the positioning portion.

As shown in FIG. 4A and FIG. 4B, the portion to be positioned of the inkjet section B is provided on a rear side face of the first frame 4 and is composed of a box-shaped block guide 4*a* having a trapezoidal shape in a plan view and having an inclination portion.

On the other hand, the positioning portion of the treating section C1 is provided on a front side face of the second frame 5, and is composed of a plate guide 5*a*. The plate guide 5*a* has an L shape in a plan view, and is provided with a folded portion T and a standing portion S extending from a distal end of the folded portion T rearward, a distal end portion of the standing portion S being slightly bent outward.

In the inkjet recording apparatus 100, when the second frame 5 of the treating section C1 is made close to the first frame 4 of the inkjet section B, an inner wall of the plate guide 5*a* is caused to abut on the inclination portion 41 of the block guide 4*a*, and the plate guide 5*a* is guided along the inclination portion 41 from the abutting state of the plate guide 5*a* on the inclination portion 41.

By causing at least two faces (different faces of the inner wall) of the plate guide 5*a* to abut on two faces of the block guide 4*a*, positioning of the treating section C1 to the inkjet section B is achieved regarding front and rear, and left and right directions thereof.

That is, by causing the folded portion T of the plate guide 5*a* to abut on the front face of the block guide 4*a*, the positioning of the treating section C1 to the inkjet section B in the front and rear directions is performed, so that hooking to the hook portion 52 can be performed accurately by only rotating the above-described coupling lever 53 simply.

Further, by causing the standing portion S of the plate guide 5*a* to abut on a side face of the block guide 4*a*, the positioning of the treating section C1 to the inkjet section B in the left and right directions can be achieved, so that it becomes possible to hook the above-described coupling lever 53 to the hook portion 52 at a proper position.

According to the above-described operations, it becomes possible to couple the inkjet section B and the treating section C1 with each other easily, and simultaneously positioning of the treating section C1 to the inkjet section B can be performed easily.

Returning back to FIG. 1, as described above, the treating section C1 is attachable to and detachable from the inkjet section B. Therefore, for example, by exchanging the treating section C1 with another treating section C2 described later in response to the characteristic of the medium for recording, a high efficiency is obtained, a high quality is maintained, and appropriate accommodation to an apparatus at a post process becomes possible.

Figure 5:
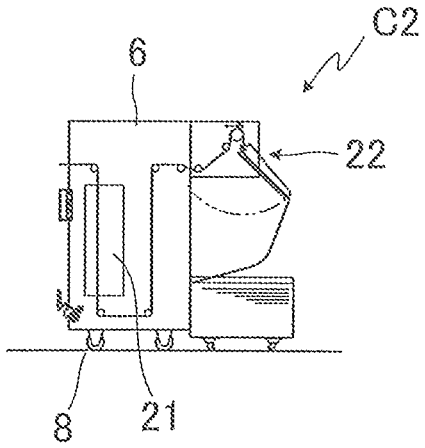
FIG. 5 is a schematic side view showing another treating section of the inkjet recording apparatus according to the first embodiment.

FIG. 5 is a schematic side view showing another treating section of the inkjet recording apparatus according to the first embodiment.

As shown in FIG. 5, another treating section C2 has a structure where a drying section 21 having a heating and drying apparatus (not shown) and a folding type collecting section 22 for folding a dried recorded medium 1*a* to collect the same are housed in a third frame 6 to be integrated with each other.

Further, a front portion of the third frame 6 of the treating section C2 is provided with a pair of left and right positioning portions and coupling portion.

It should be noted that the positioning portion and the coupling portion are identical with those in the above-described treating section C1. Therefore, the treating section C2 is coupled and positioned to the inkjet section B like the treating section C1.

Further, since casters 8 are attached to a lower end portion of the treating section C2, attaching and detaching of the treating section C2 can be performed easily by utilizing the casters 8.

In the treating section C2, when a recorded medium 1*a* transported from the inkjet section B reaches the drying section 21, it is heated and dried by the heating and drying apparatus while being transported as it is.

The heated and dried recorded medium 1*a* is shaken off in a folding fashion by the folding type collecting section 22 so that the recorded medium 1*a* which has been subjected to the inkjet recording is collected.

It should be noted that since the recorded medium 1*a* is folded and collected by the folding type collecting section 22 in the treating section C2, a knit which hardly ceases or the like is suitably used as the medium for recording 1. Further, the drying section 21 suitable to such a material can be adopted.

In the inkjet recording apparatus 100 according to the first embodiment, since the treating section C1 and the treating section C2 are attachable to and detachable from the inkjet section B, by selecting the aspect of collection in response to the characteristic of the recorded medium 1*a*, quality deterioration at a collecting time is prevented and appropriate accommodation to an apparatus at a post process becomes possible.

Second Embodiment

In the inkjet recording apparatus according to the present invention, since the treating section C1 is attachable and detachable, a plurality of independent inkjet sections B can be arranged in series.

The treating section can be attached to the inkjet section on the most downstream side.

Figure 6:
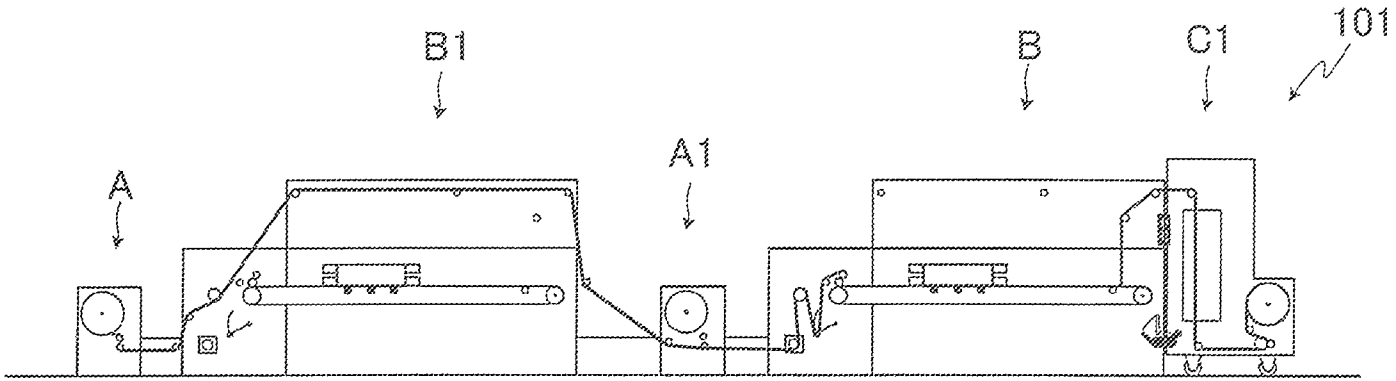
FIG. 6 is a schematic side view showing an inkjet recording apparatus according to a second embodiment.

FIG. 6 is a schematic side view showing an inkjet recording apparatus according to a second embodiment.

As shown in FIG. 6, an inkjet recording apparatus 101 according to the second embodiment is provided with a fabric feeding section A having a medium for recording, an upstream-side inkjet section B1 (hereinafter, called "first inkjet section" for convenience) and a downstream-side inkjet section (hereinafter, called "second inkjet section" for convenience) which perform inkjet recording to a medium for recording fed form the fabric feeding section A, a fabric feeding section A1 (hereinafter, called "second fabric feeding section" for convenience) provided between the first inkjet section B1 and the second inkjet section B, and a treating section C1 having a drying section for drying a recorded medium and a taking-up type collecting section for taking up a dried recorded medium to collect the same, the drying section and the taking-up type collecting section being integrated with each other.

That is, the inkjet recording apparatus 101 according to the second embodiment is similar to the inkjet recording apparatus 100 according to the first embodiment except that it is further provided with the first inkjet section B1 and the second fabric feeding section A1.

The second fabric feeding section A1 has a structure similar to the fabric feeding section A described above (hereinafter; called "first fabric feeding section" for convenience) of the inkjet recording apparatus 100 according to the first embodiment.

It should be noted that one of the first fabric feeding section A and the second fabric feeding section A1 is used at an actual operation time in the inkjet recording apparatus 101. That is, when the first fabric feeding section A is used, the second fabric feeding section A1 is not used.

The first inkjet section B1 has a structure similar to the second inkjet section B described above except that it does not have the portion to be positioned and the portion to be coupled.

Therefore, inkjet recording is also performed to the medium for recording 1 by the serial-type recording head 3 in the first inkjet section B1.

Since the inkjet recording apparatus 101 is provided with the first inkjet section B1 and the second inkjet section B connected in series, the number of kinds of ink to be used to the medium for recording 1 can be increased.

Further, different types of ink are charged into the first inkjet section B1 and the second inkjet section B, respectively, so that inkjet recording can also be performed in response to 1 the characteristics of the medium for recording.

In addition, in the inkjet recording apparatus, it is possible to perform inkjet recording via a plurality of routes described below.

Figure 7A:
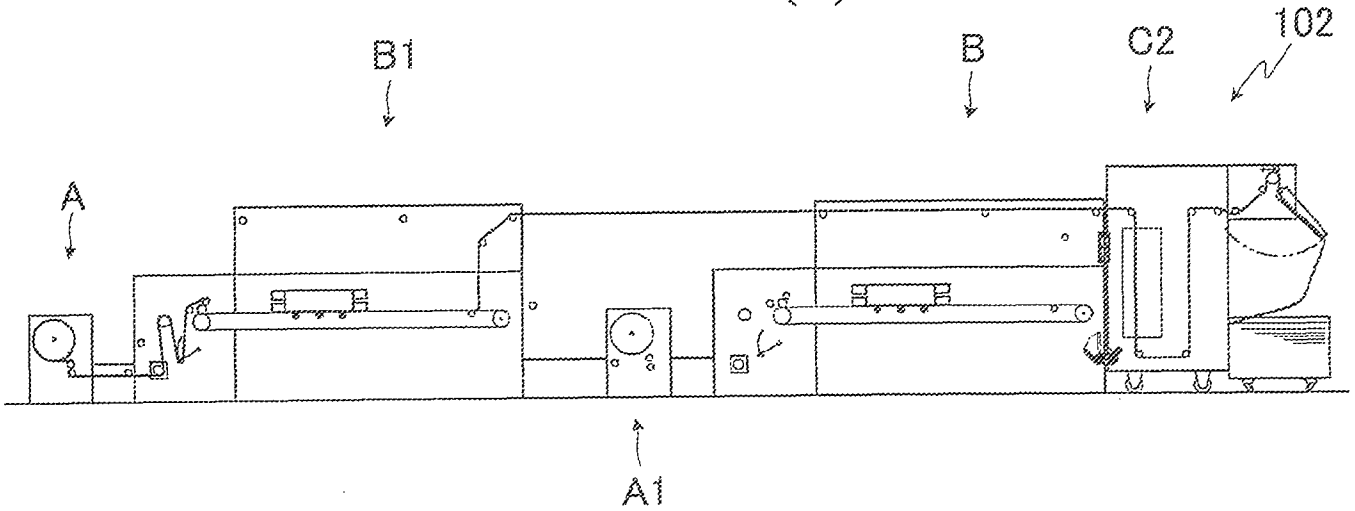
FIGS. 7A and 7B are schematic side views showing inkjet recording apparatuses according to other embodiments.
Figure 7B:
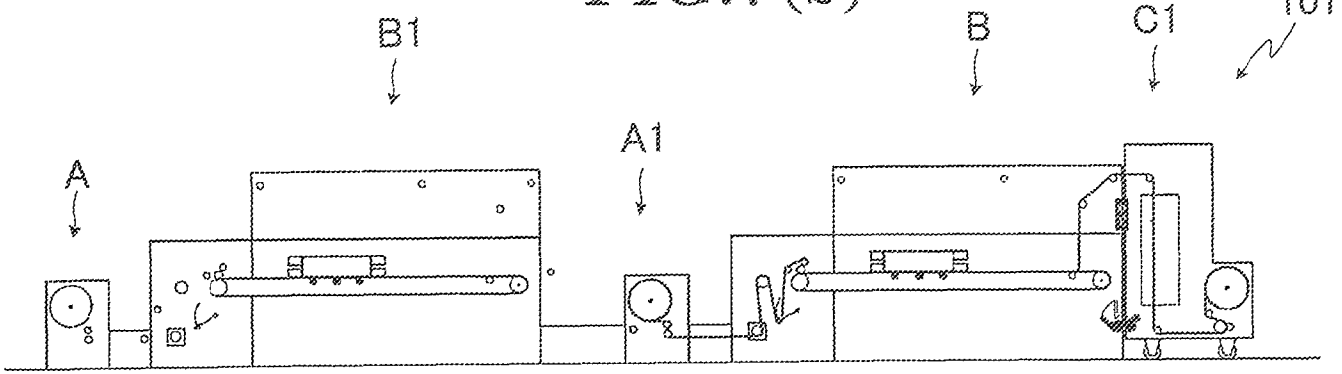

(1) Route where a medium for recording 1 is set at the first fabric feeding section A and inkjet recording is performed by only the inkjet section B (see FIG. 6):

(2) Route where a medium for recording 1 is set at the first fabric feeding section A and inkjet recording is performed by only the inkjet section B1 (see FIG. 7A):

(3) Route where a medium for recording 1 is set at the first fabric feeding section A and inkjet recording is performed by the first inkjet section B1 and the second inkjet section B: and (4) Route where a medium for recording 1 is set at the second fabric feeding section A1 and inkjet recording is performed by the inkjet section B (see FIG. 7B).

In the inkjet recording apparatus 101 according to the second embodiment, since the treating section C1 and the treating section C2 are attachable to and detachable from the inkjet section B like the inkjet recording apparatus 100 according to the first embodiment, quality deterioration at a collecting time is prevented and appropriate accommodation to an apparatus at a post process can be made possible by selecting the aspect of collection.

Though the embodiments of the present invention have been described above, the present invention is not limited to the above embodiments.

For example, in the inkjet recording apparatus 100, 101 according to the embodiment, a structure of the collecting section is only required to being capable of collecting the recorded medium, and the collecting section is not limited to the taking-up type collecting section 12 or the folding type collecting section 22.

In the inkjet recording apparatus 100, 101 according to the embodiment, the recording head 3 is one of the serial type, but it may be one of a line type.

In the inkjet recording apparatus 100, 101 according to the embodiment, the portion to be coupled and the portion to be positioned are provided at the rear portion of the inkjet section B and the coupling portion and the positioning portion are provided at the front portion of the treating section, but these configurations are not essential configurations necessarily.

Further, the coupling portion is composed of the projecting coupling pin 4*b* and the portion to be positioned is composed of the box-type block guide 4*a* having the inclination portion, but these portions are not limited to these structures.

Similarly, the coupling portion is composed of the shaft portion 51 and the coupling lever 53, and the positioning portion is composed of the plate guide 5*a*, but these portions are not limited to these structures.

In the inkjet recording apparatus 100, 101 according to the embodiment, the casters 8 are attached to the lower end portions of the treating section C1, C2, but they are not essential configurations necessarily.

The inkjet recording apparatus 101 according to the second embodiment is provided with the first inkjet section B1 and the second inkjet section B, but another inkjet section may be provided in series with these inkjet sections B1 and B.

Figure 8:
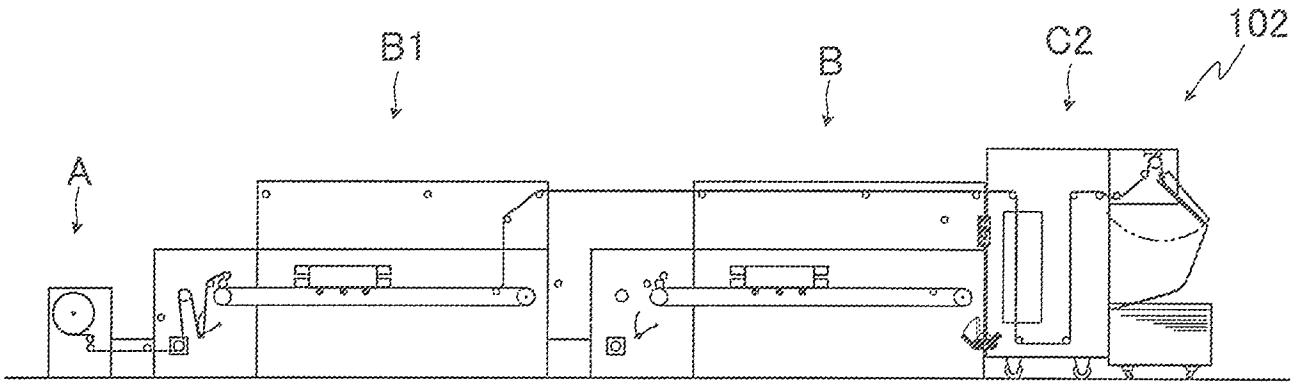
FIG. 8 is a schematic side view showing an inkjet recording apparatus according to another embodiment.

The inkjet recording apparatus 101 according to the second embodiment is provided with the second fabric feeding section A1, but the second fabric feeding section A1 is not essential necessarily (see FIG. 8).

INDUSTRIAL APPLICABILITY

The inkjet recording apparatus of the present invention can be utilized as an apparatus for performing recording on a medium for recording composed of a fabric according to an inkjet system. According to such an inkjet recording apparatus, quality deterioration at a collecting time is prevented and appropriate accommodation to an apparatus at a post process is made possible by making the aspect of collection selectable.

REFERENCE SIGNS LIST

1 . . . medium for recording,
1*a* . . . recorded medium,
2 . . . transporting conveyer,
3 . . . recording head,
4 . . . first frame,
4*a* . . . block guide,
4*b* . . . coupling pin
5 . . . second frame,
5*a* . . . plate guide,
6 . . . third frame,
8 . . . caster,
11, 21 . . . drying section,
12 . . . taking-up type collecting section,
22 . . . folding type collecting section,
51 . . . shaft portion,
52 . . . hook portion,
53 . . . coupling lever,
55 . . . retaining pin,
100, 101, 102 . . . inkjet recording apparatus,
A . . . fabric feeding section (first fabric feeding section),
A1 . . . second fabric feeding section,
B . . . inkjet section (second inkjet section),
B1 . . . first inkjet section,
C1, C2 . . . treating section,
P1, P2 . . . portion,
S . . . standing portion,
T . . . folded portion,

The invention claimed is:

1. An inkjet recording apparatus comprising:

a fabric feeding section having a medium for recording composed of a fabric;

an inkjet section for performing inkjet recording on the medium for recording fed from the fabric feeding section to form a recorded medium; and a treating section having a drying section for drying the recorded medium and a collecting section for collecting the dried recorded medium, the drying section and the collecting section being integrated with each other, wherein the treating section is attachable to and detachable from the inkjet section, a rear portion of the inkjet section is provided with a portion to be positioned with respect to the treating section composed of a box-shaped block guide having an inclination portion, a front portion of the treating section is provided with a positioning portion composed of an L-shaped plate guide, and by causing at least two faces of the plate guide to abut on the block guide, the treating section is positioned with respect to the inkjet section.

2. The inkjet recording apparatus according to claim 1, wherein the collecting section is a collecting section for taking up the recorded medium to collect the same or for folding the recording material to collect the same, and by attaching/detaching the treating section to/from the inkjet section, the treating section provided with the collecting section for taking up the recorded medium and the treating section provided with the collecting section for folding the recording medium can be exchanged with each other.

3. The inkjet recording apparatus according to claim 1, wherein a rear end portion of the inkjet section is provided with a portion to be coupled, a front portion of the treating section is provided with a coupling portion, and the portion to be coupled and the coupling portion are coupled so that the treating section and the inkjet section are coupled to each other.

4. The inkjet recording apparatus according to claim 3, wherein the portion to be coupled is composed of a projecting coupling pin, and the coupling portion is composed of a shaft portion and a coupling lever having a hook portion and rotatable about the shaft portion.

5. The inkjet recording apparatus according to claim 1, wherein a plurality of the inkjet sections are arranged in series.

6. The inkjet recording apparatus according to claim 5, further comprising another fabric feeding section provided between the inkjet sections adjacent to each other.

7. The inkjet recording apparatus according to claim 1, wherein the inkjet recording is performed by a serial recording head.

8. The inkjet recording apparatus according to claim 1, wherein casters are provided on a lower end portion of the treating section.

9. The inkjet recording apparatus according to claim 1, wherein the plate guide is provided with a folded portion and a standing portion extending from a distal end of the folded portion rearward, a distal end portion of the standing portion being bent outward.

10. The inkjet recording apparatus according to claim 1, wherein different types of ink are provided in upstream side inkjet section and an downstream side inkjet section, respectively, for allowing inkjet recording to be performed in response to a characteristic of the medium for recording.

* * * * *